US011074854B1

(12) United States Patent
Lu et al.

(10) Patent No.: US 11,074,854 B1
(45) Date of Patent: Jul. 27, 2021

(54) DRIVING DEVICE AND OPERATION METHOD THEREOF

(71) Applicant: Novatek Microelectronics Corp., Hsinchu (TW)

(72) Inventors: Yu-Tsung Lu, Hsinchu (TW); Chang-Hung Chen, Hsinchu County (TW)

(73) Assignee: Novatek Microelectronics Corp., Hsinchu (TW)

( * ) Notice: Subject to any disclaimer, the term of this patent is extended or adjusted under 35 U.S.C. 154(b) by 0 days.

(21) Appl. No.: 16/812,389

(22) Filed: Mar. 9, 2020

(51) Int. Cl.
*G09G 3/3208* (2016.01)

(52) U.S. Cl.
CPC ... *G09G 3/3208* (2013.01); *G09G 2310/0297* (2013.01); *G09G 2310/08* (2013.01); *G09G 2320/064* (2013.01)

(58) Field of Classification Search
CPC ..... G09G 3/3208; G09G 3/00; G09G 3/3266; G09G 3/3275; G09G 2310/0297; G09G 2310/08; G09G 2320/064
USPC ..... 345/204
See application file for complete search history.

(56) References Cited

U.S. PATENT DOCUMENTS 8,299,982 B2 * 10/2012 Chung ..... G11C 19/28 345/76
8,542,225 B2 * 9/2013 Han ..... G09G 3/3225 345/209
9,129,562 B2 * 9/2015 Jang ..... G11C 19/28
2005/0253791 A1 * 11/2005 Shin ..... G09G 3/3266 345/76
2005/0285827 A1 * 12/2005 Eom ..... G09G 3/3233 345/76
2013/0100173 A1 * 4/2013 Chaji ..... G09G 5/10 345/690
2013/0222437 A1 * 8/2013 Ka ..... G09G 3/3233 345/690
2015/0138251 A1 * 5/2015 Pyo ..... G09G 3/3233 345/690
2015/0145899 A1 * 5/2015 Sugihara ..... G09G 3/3233 345/691
2017/0102589 A1 * 4/2017 Yang ..... G09G 3/2003
2019/0012948 A1 * 1/2019 Ohara ..... G09G 3/3233
2019/0371244 A1 * 12/2019 Peng ..... G09G 3/3266

* cited by examiner

*Primary Examiner* — Tom V Sheng
(74) *Attorney, Agent, or Firm* — JCIPRNET

(57) ABSTRACT

A driving device and an operation method thereof are provided. The driving device drives a plurality of light-emitting control lines of an organic light emitting diode (OLED) display panel. The light-emitting control lines are divided into a plurality of groups. The driving device includes a control circuit and a plurality of logic gates. The control circuit generates a global light-emitting control signal and determines a duty cycle of the global light-emitting control signal. Any one of the logic gates determines whether to transmit the global light-emitting control signal to the light-emitting control lines of a corresponding group among the groups. When the global light-emitting control signal is transmitted to a corresponding light-emitting control line among the light-emitting control lines, a pulse of the global light-emitting control signal may light up a plurality of pixels connected to the corresponding light-emitting control line.

10 Claims, 6 Drawing Sheets

DRIVING DEVICE AND OPERATION METHOD THEREOF

BACKGROUND

Field of the Invention

The invention relates to a display device and more particularly, to a driving device and an operation method thereof.

Description of Related Art

Generally, in addition to a plurality of data lines and a plurality of scan lines, an organic light-emitting diode (OLED) display panel also includes a plurality of light-emitting control lines. A driving device may scan these scan lines, so as to write a plurality of gray scale information (pixel voltages) into different pixel units (pixel circuits) of the OLED display panel through the data lines. The driving device may drive the light-emitting control lines of the OLED display panel, so as to light up the pixel units connected to the light-emitting control lines.

Generally, these light-emitting control lines of the OLED display panel are connected to a shift register. A plurality of logical values in a light-emitting control signal of the driving device are input into the shift register in a serial manner. The shift register is like a serial-in and parallel-out (SIPO) circuit. Based on a trigger by a clock signal, the light-emitting control signal may shift between a plurality of registers of the shift register, and the registers of the shift register may output the light-emitting control signal to the light-emitting control lines of the OLED display panel. In general, a duration of a period of the clock signal is a line time of the OLED display panel.

It should be noted that the contents of the section of "Description of Related Art" is used for facilitating the understanding of the invention. A part of the contents (or all of the contents) disclosed in the section of "Description of Related Art" may not pertain to the conventional technology known to the persons with ordinary skilled in the art. The contents disclosed in the section of "Description of Related Art" do not represent that the contents have been known to the persons with ordinary skilled in the art prior to the filing of this invention application.

SUMMARY

The invention provides a driving device and an operation method thereof for driving an organic light emitting diode (OLED) display panel.

A driving device of the invention is configured to drive a plurality of light-emitting control lines of an OLED display panel. The light-emitting control lines are divided into a plurality of groups. The driving device includes a control circuit and a plurality of logic gates. The control circuit is configured to generate a global light-emitting control signal and determine a duty cycle of the global light-emitting control signal. The logic gates are coupled to the control circuit to receive the global light-emitting control signal. An output terminal of any one of the logic gates is configured to be coupled to the light-emitting control lines of a corresponding group among the groups, so as to determine whether to transmit the global light-emitting control signal to the light-emitting control lines of the corresponding group. When the global light-emitting control signal is transmitted to a corresponding light-emitting control line among the light-emitting control lines, a pulse of the global light-emitting control signal lights up a plurality of pixels connected to the corresponding light-emitting control line.

An operation method of the invention includes: generating a global light-emitting control signal and determining a duty cycle of the global light-emitting control signal by a control circuit; determining whether to transmit the global light-emitting control signal to the light-emitting control lines of a corresponding group among a plurality of groups by any one of the logic gates; and when the global light-emitting control signal is transmitted to a corresponding light-emitting control line among the light-emitting control lines, lighting up a plurality of pixels connected to the corresponding light-emitting control line by a pulse of the global light-emitting control signal.

To sum up, the control circuit provided by the embodiments of the invention can generate the global light-emitting control signal and determine the duty cycle of the global light-emitting control signal. An adjustment accuracy (resolution) of the duty cycle of the global light-emitting control signal can be irrelevant to a line time of the OLED display panel.

For example, in some embodiments, an adjustment step of the duty cycle of the global light-emitting control signal can be smaller to a line time of the OLED display panel.

To make the above features and advantages of the invention more comprehensible, embodiments accompanied with drawings are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF EMBODIMENTS

Figure 1:
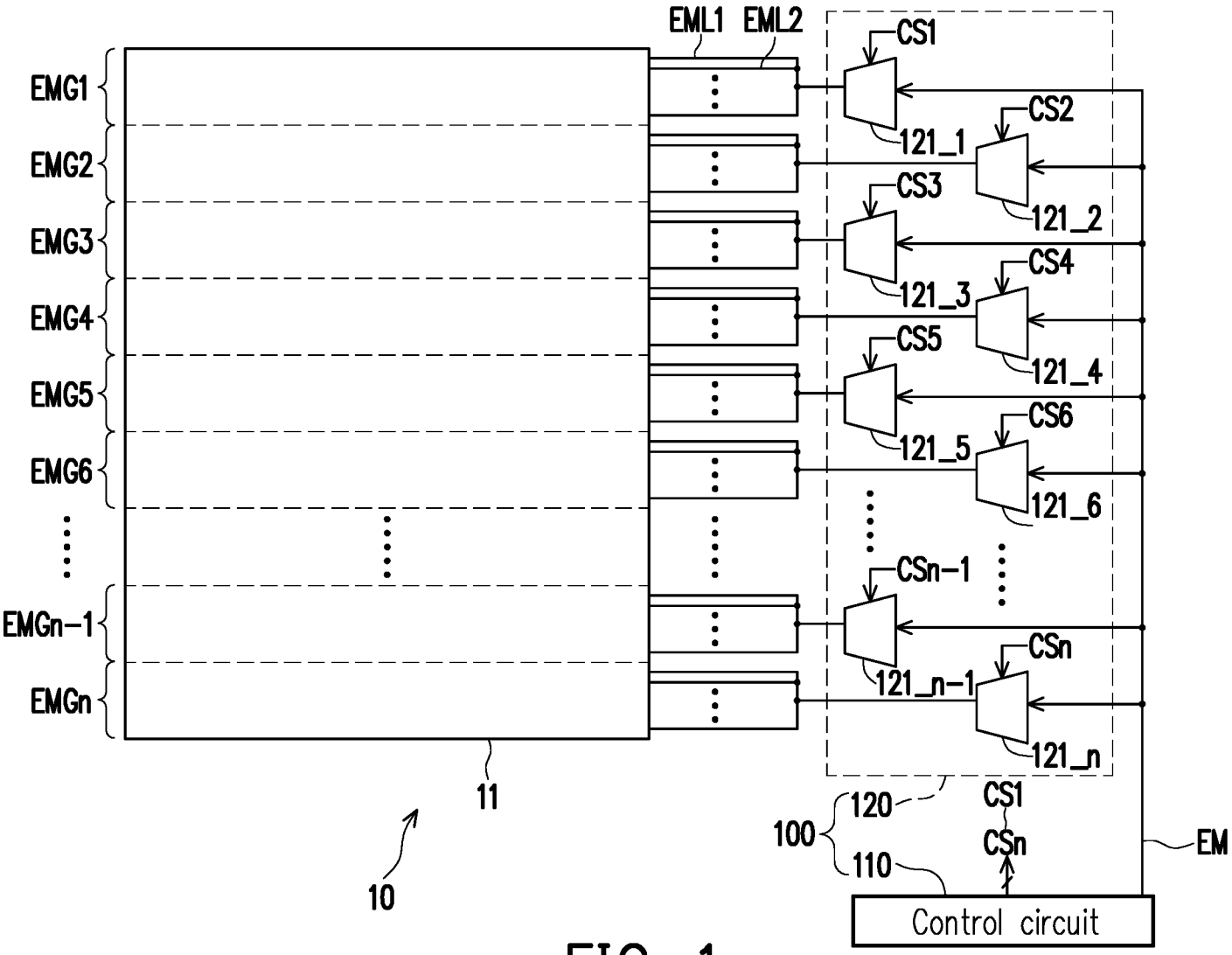
FIG. 1 is a schematic circuit block diagram illustrating a display device according to an embodiment of the invention.

The term "couple (or connect)" throughout the specification (including the claims) of this application are used broadly and encompass direct and indirect connection or coupling means. For example, if the disclosure describes a first device being coupled (or connected) to a second device, then it should be interpreted that the first device can be directly connected to the second device, or the first device can be indirectly connected to the second device through other devices or by a certain coupling means. Terms such as "first" and "second" mentioned throughout the specification (including the claims) of this application are only for naming the names of the elements or distinguishing different embodiments or scopes and are not intended to limit the upper limit or the lower limit of the number of the elements not intended to limit sequences of the elements. Moreover, elements/components/steps with same reference numerals represent same or similar parts in the drawings and embodiments. Elements/components/notations with the same reference numerals in different embodiments may be referenced to the related description.

FIG. 1 is a schematic circuit block diagram illustrating a display device 10 according to an embodiment of the invention. The display device 10 includes an organic light emitting diode (OLED) display panel 11 and a driving device 100. In the embodiment illustrated in FIG. 1, the driving device 100 includes a control circuit 110 and a plurality of logic gates 120. The OLED display panel 11 has a plurality of light-emitting control lines, for example, light-emitting control lines EML1 and EML2. The driving device 100 may drive the light-emitting control lines of the OLED display panel 11 to light up a plurality of pixel units (not shown) connected to the light-emitting control lines. The implementation manner of the OLED display panel 11 is not limited in the present embodiment. Based on a design requirement, in some embodiments, the OLED display panel 11 may be a conventional OLED display panel or other OLED display panels.

The light-emitting control lines of the OLED display panel 11 are divided into a plurality of groups. For example, the light-emitting control lines of the OLED display panel 11 are divided into groups EMG1, EMG2, EMG3, EMG4, EMG5, EMG6, . . . , EMGn−1 and EMGn. The number n of the groups may be determined based on a design requirement. If it is assumed that the number of the light-emitting control lines of the OLED display panel 11 is N, the number n of the groups may be less than or equal to the number N of the light-emitting control lines.

Figure 2:
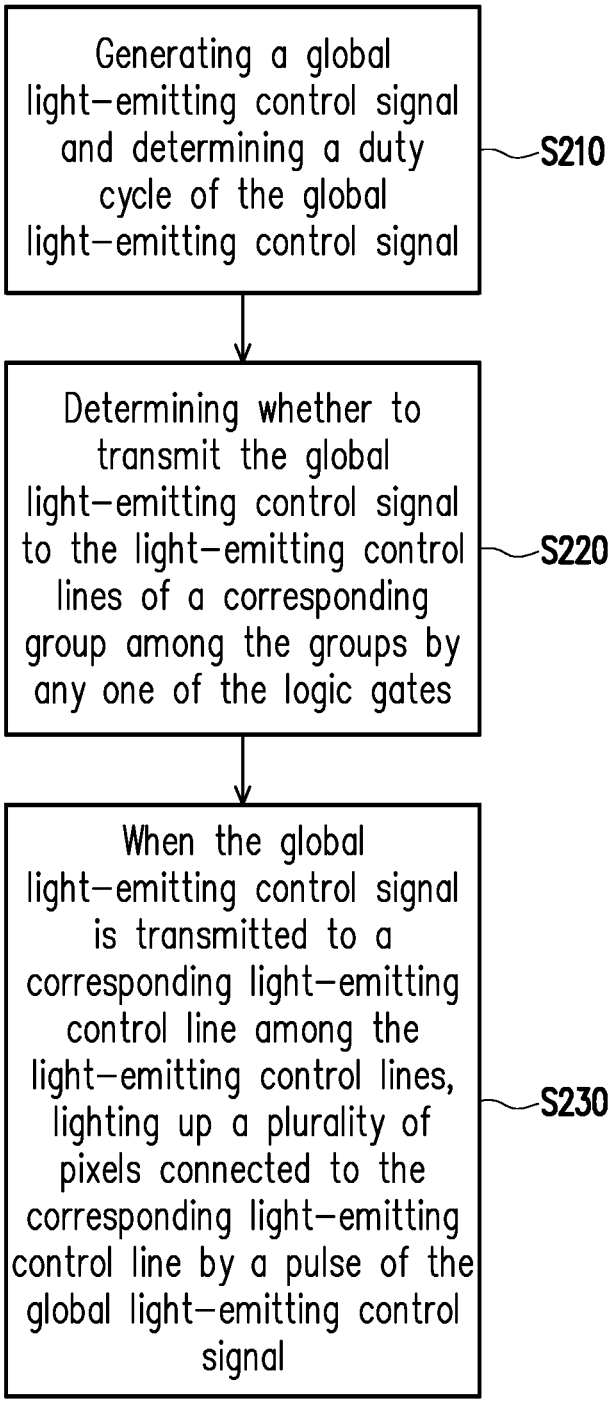
FIG. 2 is a flowchart illustrating an operation method of a driving device according to an embodiment of the invention.

FIG. 2 is a flowchart illustrating an operation method of a driving device according to an embodiment of the invention. Referring to FIG. 1 and FIG. 2, the control circuit 110 may generate a global light-emitting control signal EM and determine a duty cycle of the global light-emitting control signal EM (step S210). An adjustment accuracy (resolution) of the duty cycle of the global light-emitting control signal EM may be irrelevant to a line time of the OLED display panel 11. For example, in some embodiments, an adjustment step of the duty cycle of the global light-emitting control signal EM may be smaller to a line time of the OLED display panel 11.

The logic gates 120 are coupled to the control circuit 110 to receive the global light-emitting control signal EM. An output terminal of any one of the logic gates 120 is configured to be coupled to the light-emitting control lines of a corresponding group among the groups EMG1 to EMGn of the OLED display panel. Any one of the logic gates 120 may determine whether to transmit the global light-emitting control signal EM to the light-emitting control lines of the corresponding group among the groups EMG1 to EMGn (step S220).

When the global light-emitting control signal EM is transmitted to a corresponding light-emitting control line among the light-emitting control lines of the OLED display panel 11, a pulse of the global light-emitting control signal EM may light up a plurality of pixels connected to the corresponding light-emitting control line (step S230). Otherwise, when the global light-emitting control signal EM is blocked from the corresponding light-emitting control line, the pixels connected to the corresponding light-emitting control line are incapable of being lit (i.e., the pixels are maintained in a non-lighting state).

In the embodiment illustrated in FIG. 1, the logic gates 120 include multiplexers 121_1, 121_2, 121_3, 121_4, 121_5, 121_6, . . . , **121_*n*−1 and 121_*n*. An output terminal of the multiplexer 121_1 is configured to be coupled to the light-emitting control lines (e.g., the light-emitting control lines EML1 and EML2) of the group EMG1 (a corresponding group) among the groups EMG1 to EMGn. An input terminal of the multiplexer 121_1 is coupled to the control circuit 110 to receive the global light-emitting control signal EM. A control terminal of the multiplexer 121_1 is coupled to the control circuit 110 to receive a control signal CS1. Based on the control of the control signal CS1 of the control circuit 110, the multiplexer 121_1 may determine whether to transmit the global light-emitting control signal EM to the light-emitting control lines (e.g., the light-emitting control lines EML1 and EML2) of the group EMG1**.

The rest of the multiplexers 121_2 to **121_*n* may be inferred with reference to the description related to the multiplexer 121_1 and thus, will not be repeated. Based on the control of control signals CS1, CS2, CS3, CS4, CS5, CS6, . . . , CSn−1 and CSn of the control circuit 110, each of the multiplexers 121_1 to 121_*n* may determine whether to transmit the global light-emitting control signal EM to the light-emitting control lines of the corresponding group among the groups EMG1** to EMGn.

Figure 3:
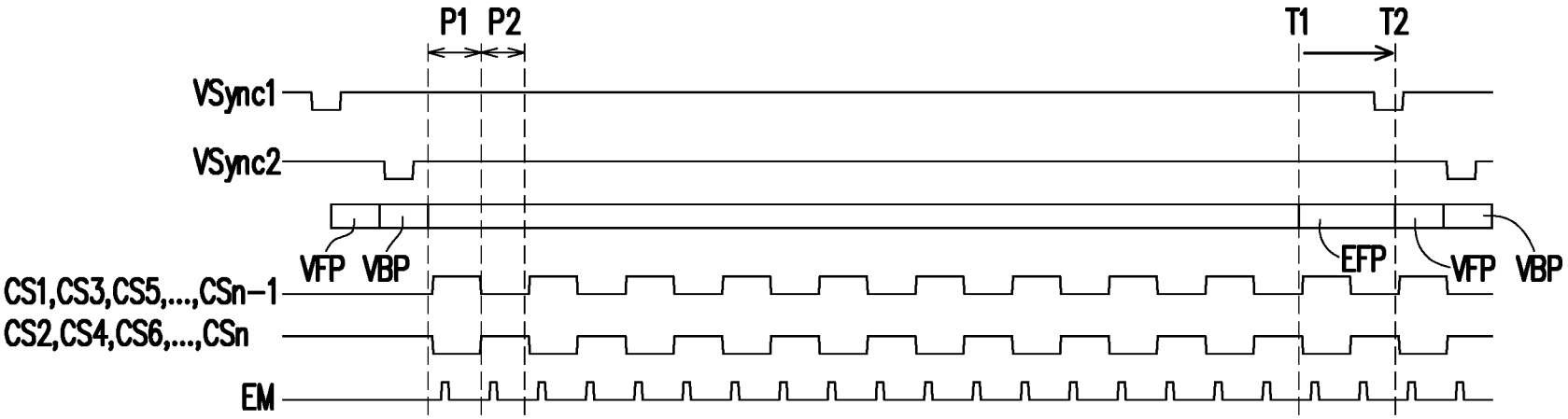
FIG. 3 is a schematic timing diagram illustrating the signals depicted in FIG. 1 according to an embodiment of the invention.

FIG. 3 is a schematic timing diagram illustrating the signals depicted in FIG. 1 according to an embodiment of the invention. The lateral axis illustrated in FIG. 3 represent the time. As illustrated in FIG. 3, Vsync1 represents an external vertical synchronization signal, and Vsync2 represents an internal vertical synchronization signal. The vertical synchronization signal Vsync1 may define a frame period. A frame period includes a front porch period VFP and a back porch period VBP.

Referring to FIG. 1 and FIG. 3, a frame period is divided into a plurality of sub periods, for example, sub periods P1 and P2. During the sub period P1, a logic gate (e.g., the multiplexer 121_2) among the logic gates 120 blocks the global light-emitting control signal EM from being transmitted to the light-emitting control lines of a corresponding group (e.g., the group EMG2) among the groups EMG1 to EMGn. During the sub period P2, the same logic gate (e.g., the multiplexer 121_2) may transmit the global light-emitting control signal EM to the light-emitting control lines of the corresponding group (e.g., the group EMG2).

According to an actual operation of the system, a length of the frame period may be dynamically changed. Taking the embodiment illustrated in FIG. 3 for example, an end time point of the frame period is delayed from a time point T1 to a time point T2. Namely, the front porch period VFP is additionally added by an extended front porch period EFP. During this extended period (i.e., a period from the time point T1 to the time point T2), the control circuit 110 may continue providing the control signals CS1 to CSn and maintain the duty cycle of the global light-emitting control signal EM to maintain a luminance of the OLED display panel 11.

Figure 4:
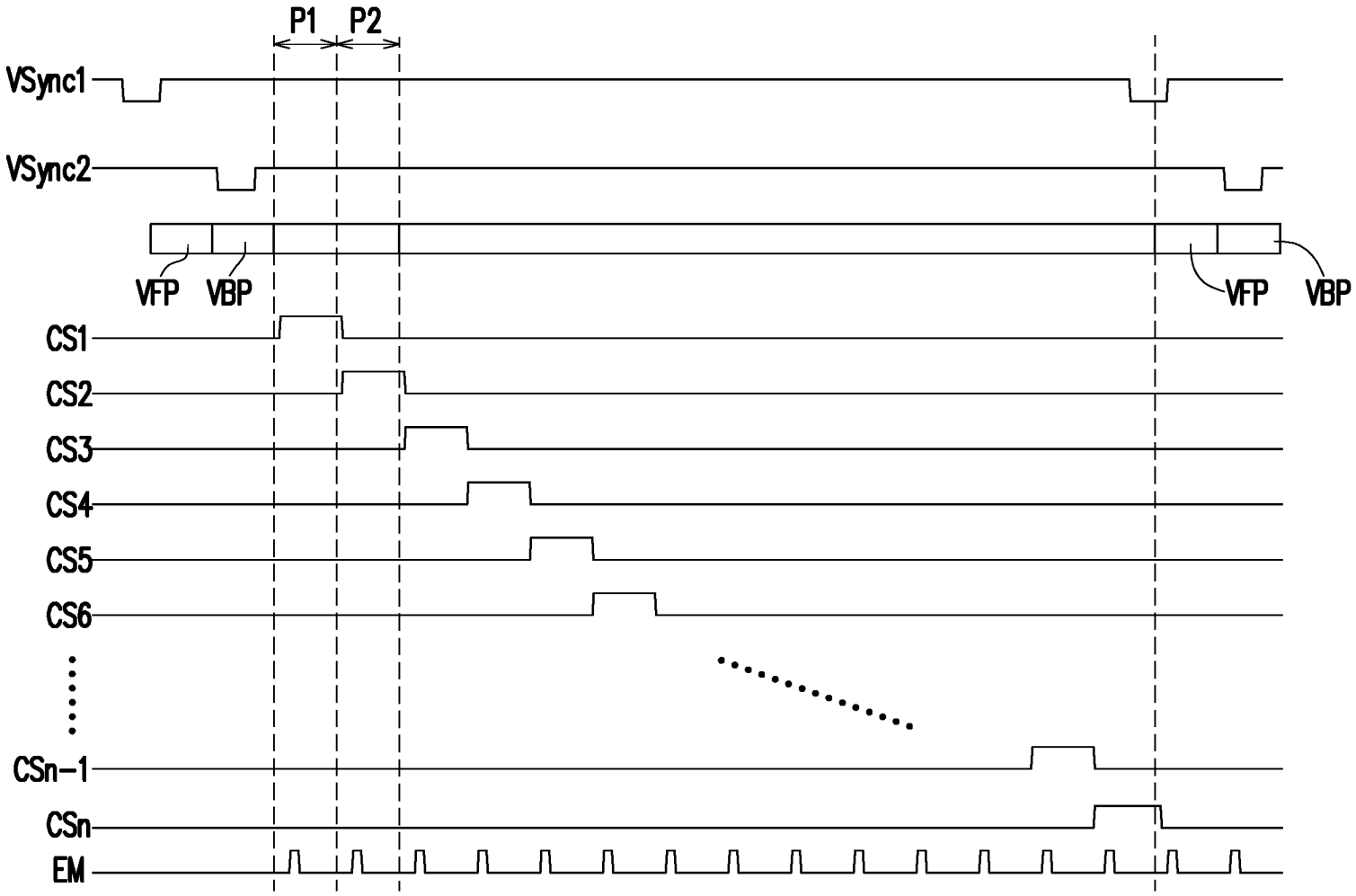
FIG. 4 is a schematic timing diagram illustrating the signals depicted in FIG. 1 according to another embodiment of the invention.

FIG. 4 is a schematic timing diagram illustrating the signals depicted in FIG. 1 according to another embodiment of the invention. The lateral axis illustrated in FIG. 4 represent the time. As illustrated in FIG. 4, Vsync1 represents an external vertical synchronization signal, and Vsync2 represents an internal vertical synchronization signal. The vertical synchronization signal Vsync1 may define a frame period. A frame period includes a front porch period VFP and a back porch period VBP. When a level of any one of the control signals CS1 to CSn is a low level, a corresponding logic gate among the logical gates 120 is turned off. When a level of one of the control signals CS1 to CSn is a high level, a corresponding logic gate among the logical gates 120 is turned on.

Referring to FIG. 1 and FIG. 4, a frame period is divided into a plurality of sub periods, for example, sub periods P1 and P2. During the sub period P1, a logic gate (e.g., the multiplexer 121_2) among the logic gates 120 may block the global light-emitting control signal EM from being transmitted to the light-emitting control lines of a corresponding group (e.g., the group EMG2) among the groups EMG1 to EMGn. During the sub period P2, the same logic gate (e.g., the multiplexer 121_2) may transmit the global light-emitting control signal EM to the light-emitting control lines of the corresponding group (e.g., the group EMG2).

Figure 5:
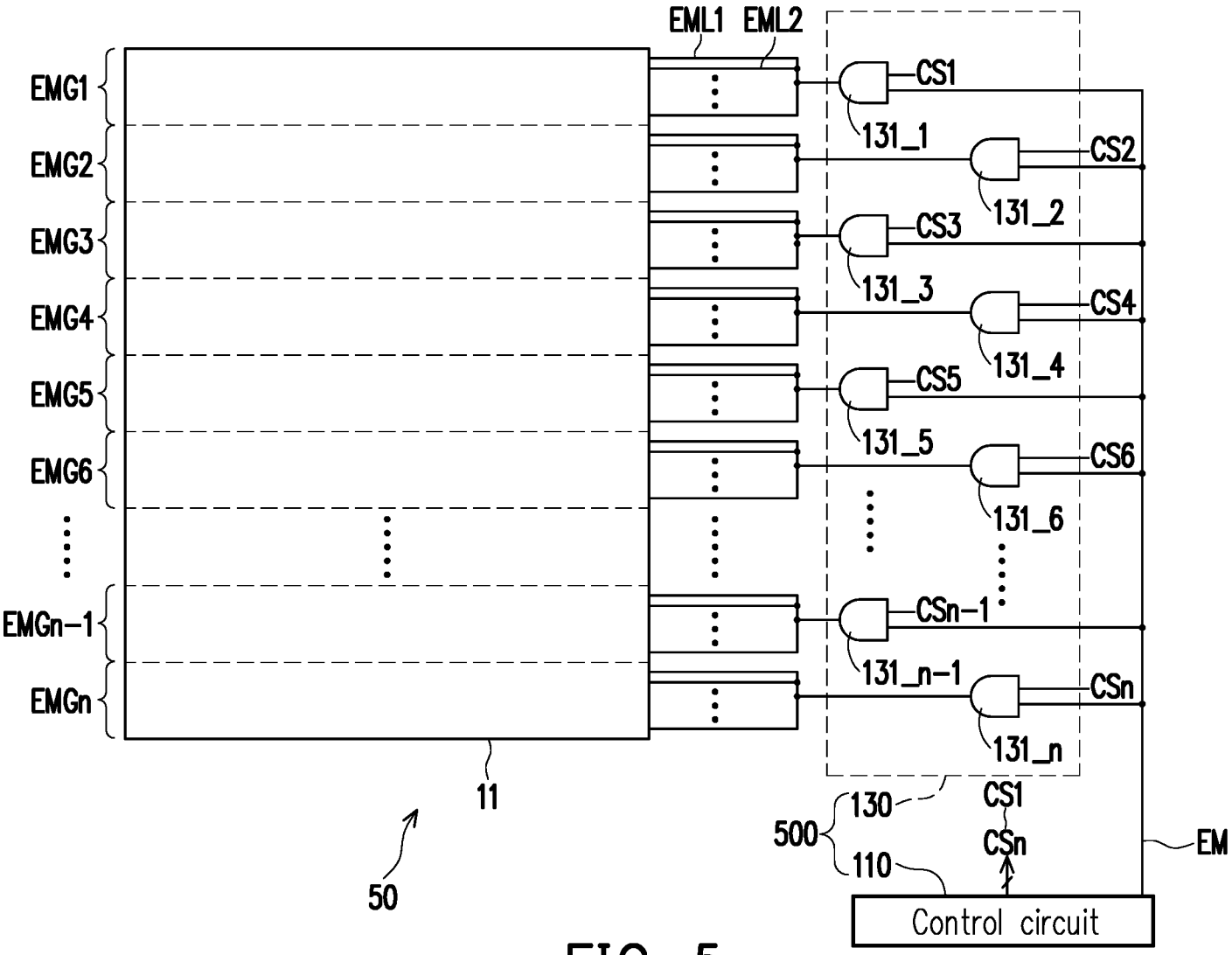
FIG. 5 is a schematic circuit block diagram illustrating a display device according to another embodiment of the invention.

FIG. 5 is a schematic circuit block diagram illustrating a display device 50 according to another embodiment of the invention. The display device 50 includes an OLED display panel 11 and a driving device 500. The OLED display panel 11 illustrated in FIG. 5 may be inferred with reference to the description related to the display panel 11 illustrated in FIG. 1 and thus, will not be repeated. In the embodiment illustrated in FIG. 5, the driving device 500 includes a control circuit 110 and a plurality of logic gates 130. The logic gates 130 illustrated in FIG. 5 may be inferred with reference to the description related to the logic gates 120 illustrated in FIG. 1, and the control circuit 110 illustrated in FIG. 5 may be inferred with reference to the descriptions related to the embodiments illustrated in FIG. 1 through FIG. 4, which will not be repeated.

In the embodiment illustrated in FIG. 5, the logic gates 130 include AND gates 131_1, 131_2, 131_3, 131_4, 131_5, 131_6, . . . , **131_*n*−1 and 131_*n*. An output terminal of the AND gate 131_1 is configured to be coupled to the light-emitting control lines (e.g., the light-emitting control lines EML1 and EML2) of the group EM1 (a corresponding group) among the groups EMG1 to EMGn. A first input terminal of the AND gate 131_1 is coupled to the control circuit 110 to receive the global light-emitting control signal EM. A second input terminal of the AND gate 131_1 is coupled to the control circuit 110 to receive the control signal CS1. Based on the control of the control signal CS1 of the control circuit 110, the AND gate 131_1 may determine whether to transmit the global light-emitting control signal EM to the light-emitting control lines (e.g., the light-emitting control lines EML1 and EML2) of the group EMG1**.

The rest of the AND gates 131_2 to **131_*n* may be inferred with reference to the description related to the AND gate 131_1 and thus, will not be repeated. Based on the control of the control signals CS1 to CSn of the control circuit 110, each of the AND gates 131_1 to 131_*n* may determine whether to transmit the global light-emitting control signal EM to the light-emitting control lines of the corresponding group among the groups EMG1** to EMGn.

Figure 6:
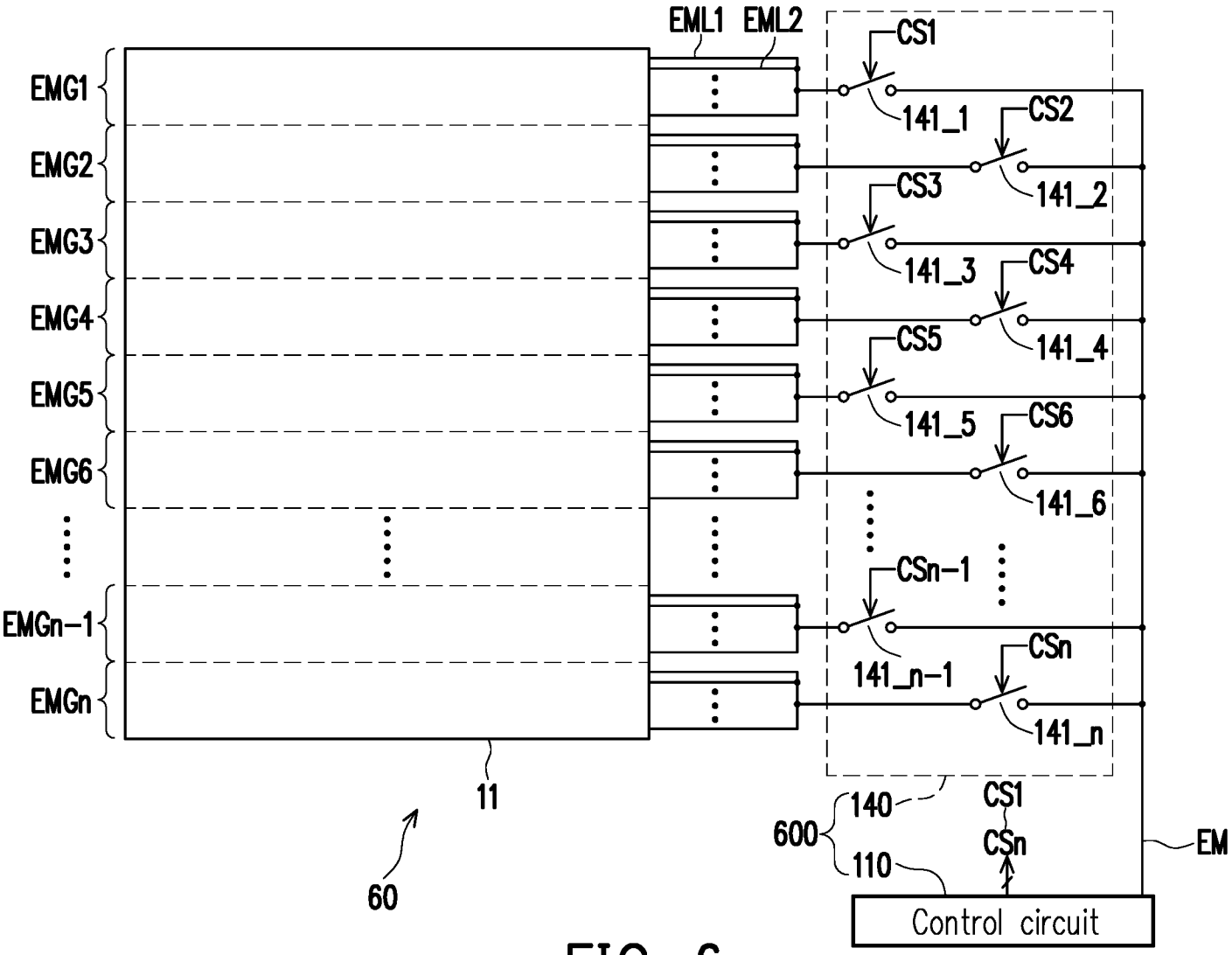
FIG. 6 is a schematic circuit block diagram illustrating a display device according to another embodiment of the invention.

FIG. 6 is a schematic circuit block diagram illustrating a display device 600 according to another embodiment of the invention. The display device 60 includes an OLED display panel 11 and a driving device 600. The OLED display panel 11 illustrated in FIG. 6 may be inferred with reference to the description related to the display panel 11 illustrated in FIG. 1 and thus, will not be repeated. In the embodiment illustrated in FIG. 6, the driving device 600 includes a control circuit 110 and a plurality of logic gates 140. The logic gates 140 illustrated in FIG. 6 may be inferred with reference to the description related to the logic gates 120 illustrated in FIG. 1, and the control circuit 110 illustrated in FIG. 6 may be inferred with reference to the descriptions related to the embodiments illustrated in FIG. 1 through FIG. 4, which will not be repeated.

In the embodiment illustrated in FIG. 6, the logic gates 140 include switches 141_1, 141_2, 141_3, 141_4, 141_5, 141_6, . . . , **141_*n*−1 and 141_*n*. A first terminal of the switch 141_1 is configured to be coupled to the light-emitting control lines (e.g., the light-emitting control lines EML1 and EML2) of the group EM1 (a corresponding group) among the groups EMG1 to EMGn. A second terminal of the switch 141_1 is coupled to the control circuit 110 to receive the global light-emitting control signal EM. A control terminal of the switch 141_1 is coupled to the control circuit 110 to receive the control signal CS1. Based on the control of the control signal CS1 of the control circuit 110, the switch 141_1 may determine whether to transmit the global light-emitting control signal EM to the light-emitting control lines (e.g., the light-emitting control lines EML1 and EML2) of the group EMG1**.

The rest of the switches 141_2 to **141_*n* may be inferred with reference to the description related to the switch 141_1 and thus, will not be repeated. Based on the control of the control signals CS1 to CSn of the control circuit 110, each of the switches 141_1 to 141_*n* may determine whether to transmit the global light-emitting control signal EM to the light-emitting control lines of the corresponding group among the groups EMG1** to EMGn.

Based on different design demands, the block of the control circuit 110 may be implemented in a form of hardware, firmware, software (i.e., programs) or in a combination of many of the aforementioned three forms.

In terms of the hardware form, the block of the control circuit 110 may be implemented in a logic circuit on an integrated circuit. Related functions of the control circuit 110 may be implemented in the hardware form by utilizing hardware description languages (e.g., Verilog HDL or VHDL) or other suitable programming languages. For example, the related functions of the control circuit 110 may be implemented in one or more controllers, a micro-controller, a microprocessor, an application-specific integrated circuit (ASIC), a digital signal processor (DSP), a field programmable gate array (FPGA) and/or various logic blocks, modules and circuits in other processing units.

In terms of the software form and/or the firmware form, the related functions of the control circuit 110 may be implemented as programming codes. For example, the control circuit 110 may be implemented by using general programming languages (e.g., C or C++) or other suitable programming languages. The programming codes may be recorded/stored in recording media, and the aforementioned recording media include, for example, a read only memory (ROM), a storage device and/or a random access memory (RAM). The programming codes may be accessed from the recording medium and executed by a computer, a central processing unit (CPU), a controller, a micro-controller or a microprocessor to accomplish the related functions. As for the recording medium, a "non-transitory computer readable medium", such as a tape, a disk, a card, a semiconductor memory or a programming logic circuit, may be used. In addition, the programs may be provided to the computer (or the CPU) through any transmission medium (e.g., a communication network or radio waves). The communication network is, for example, the Internet, wired communication, wireless communication or other communication media.

Based on the above, the control circuit provided by the embodiments of the invention can generate the global light-emitting control signal and determine the duty cycle of the global light-emitting control signal. The adjustment accuracy (resolution) of the duty cycle of the global light-emitting control signal EM can be irrelevant to a line time of the OLED display panel. For example, in some embodiments, the adjustment step of the duty cycle of the global light-emitting control signal can be smaller to a line time of the OLED display panel. The driving device provided by the embodiments of the invention can drive the OLED display panel.

It will be apparent to those skilled in the art that various modifications and variations can be made to the structure of the disclosed embodiments without departing from the scope or spirit of the disclosure. In view of the foregoing, it is intended that the disclosure cover modifications and variations of this disclosure provided they fall within the scope of the following claims and their equivalents.

What is claimed is:

1. A driving device, configured to drive a plurality of light-emitting control lines of an organic light emitting diode (OLED) display panel, the light-emitting control lines being divided into a plurality of groups, and the driving device comprising:

a control circuit, configured to generate a global light-emitting control signal and determine a duty cycle of the global light-emitting control signal; and a plurality of logic gates, coupled to the control circuit to receive the global light-emitting control signal, wherein an output terminal of any one of the logic gates is configured to be coupled to the light-emitting control lines of a corresponding group among the groups, so as to determine whether to transmit the global light-emitting control signal to the light-emitting control lines of the corresponding group, wherein when the global light-emitting control signal is transmitted to a corresponding light-emitting control line among the light-emitting control lines, a pulse of the global light-emitting control signal lights up a plurality of pixels connected to the corresponding light-emitting control line, and the control circuit is further configured to maintain the duty cycle of the global light-emitting control signal to maintain a luminance of the OLED display panel during an extended front porch period after an end time point of a frame period.

2. The driving device according to claim 1, wherein the frame period is divided into a plurality of sub periods, a first logic gate among the logic gates blocks the global light-emitting control signal from being transmitted to the light-emitting control lines of a first group among the groups during a first sub period among the sub periods, and the first logic gate transmits the global light-emitting control signal to the light-emitting control lines of the first group during a second sub period among the sub periods.

3. The driving device according to claim 1, wherein any one of the logic gates comprises:

a multiplexer, having an output terminal configured to be coupled to the light-emitting control lines of the corresponding group among the groups, wherein an input terminal of the multiplexer is coupled to the control circuit to receive the global light-emitting control signal, and a control terminal of the multiplexer is coupled to the control circuit to receive a control signal.

4. The driving device according to claim 1, wherein any one of the logic gates comprises:

an AND gate, having an output terminal configured to be coupled to the light-emitting control lines of the corresponding group among the groups, wherein a first input terminal of the AND gate is coupled to the control circuit to receive the global light-emitting control signal, and a second input terminal of the AND gate is coupled to the control circuit to receive a control signal.

5. The driving device according to claim 1, wherein any one of the logic gates comprises:

a switch, having a first terminal configured to be coupled to the light-emitting control lines of the corresponding group among the groups, wherein a second terminal of the switch is coupled to the control circuit to receive the global light-emitting control signal, and a control terminal of the switch is coupled to the control circuit to receive a control signal.

6. An operation method of a driving device configured to drive a plurality of light-emitting control lines of an OLED display panel, the light-emitting control lines being divided into a plurality of groups, and the operation method comprising:

generating a global light-emitting control signal and determining a duty cycle of the global light-emitting control signal by a control circuit;

determining whether to transmit the global light-emitting control signal to the light-emitting control lines of a corresponding group among the groups by any one of a plurality of logic gates, wherein the logic gates are coupled to the control circuit to receive the global light-emitting control signal, and an output terminal of the any one of the logic gates is configured to be coupled to the light-emitting control lines of the corresponding group among the groups;

maintaining the duty cycle of the global light-emitting control signal to maintain a luminance of the OLED display panel by the control circuit during an extended front porch period after an end time point of a frame period; and when the global light-emitting control signal is transmitted to a corresponding light-emitting control line among the light-emitting control lines, lighting up a plurality of pixels connected to the corresponding light-emitting control line by a pulse of the global light-emitting control signal.

7. The operation method according to claim 6, further comprising:

dividing the frame period into a plurality of sub periods;

blocking the global light-emitting control signal from being transmitted to the light-emitting control lines of a first group among the groups by a first logic gate among the logic gates during a first sub period among the sub periods; and transmitting the global light-emitting control signal to the light-emitting control lines of the first group during a second sub period among the sub periods.

8. The operation method according to claim 6, wherein any one of the logic gates comprises a multiplexer, an output terminal of the multiplexer is configured to be coupled to the light-emitting control lines of the corresponding group among the groups, an input terminal of the multiplexer is coupled to the control circuit to receive the global light-emitting control signal, and a control terminal of the multiplexer is coupled to the control circuit to receive a control signal.

9. The operation method according to claim 6, wherein any one of the logic gates comprises an AND gate, an output terminal of the AND gate is configured to be coupled to the light-emitting control lines of the corresponding group among the groups, a first input terminal of the AND gate is coupled to the control circuit to receive the global light-emitting control signal, and a second input terminal of the AND gate is coupled to the control circuit to receive a control signal.

10. The operation method according to claim 6, wherein any one of the logic gates comprises a switch, a first terminal of the switch is configured to be coupled to the light-emitting control lines of the corresponding group among the groups, a second terminal of the switch is coupled to the control circuit to receive the global light-emitting control signal, and a control terminal of the switch is coupled to the control circuit to receive a control signal.

* * * * *